US005299724A

United States Patent [19]

Bruski et al.

[11] Patent Number: 5,299,724

[45] Date of Patent: Apr. 5, 1994

[54] APPARATUS AND PROCESS FOR CASTING METAL MATRIX COMPOSITE MATERIALS

[75] Inventors: Richard S. Bruski, Encinitas, Calif.; Larry G. Hudson, Pulaski, N.Y.; Iljoon Jin; David J. Lloyd, both of Kingston, Canada; Michael D. Skibo, Leucadia, Calif.

[73] Assignee: Alcan International Limited, Montreal, Canada

[21] Appl. No.: 553,111

[22] Filed: Jul. 13, 1990

[51] Int. Cl.[5] ..... C22C 1/10; B22D 11/00; B22D 19/14

[52] U.S. Cl. ..... 266/207; 266/231; 266/235; 164/97; 428/614

[58] Field of Search ..... 428/614; 164/97; 266/207, 231, 235; C22C 1/10

[56] References Cited

U.S. PATENT DOCUMENTS

| | | | |
|---|---|---|---|
| 1,983,578 | 12/1934 | Chandler | 266/231 |
| 3,017,676 | 1/1962 | Ewen | 266/207 |
| 3,510,277 | 5/1970 | Schmidt | 428/614 |
| 3,839,019 | 10/1974 | Bruno et al. | 266/235 |
| 3,848,655 | 11/1974 | Sato et al. | 164/123 |
| 4,268,564 | 5/1981 | Narasimban | 164/97 |
| 4,386,958 | 6/1983 | Tyler et al. | 266/231 |
| 4,424,956 | 1/1984 | Grant et al. | 266/287 |
| 4,473,103 | 9/1984 | Kenney et al. | 164/97 |
| 4,704,169 | 11/1987 | Kimura et al. | 428/614 |
| 4,759,995 | 7/1988 | Skibo et al. | 428/614 |
| 4,786,467 | 11/1988 | Skibo et al. | 420/427 |
| 4,943,490 | 7/1990 | Bruski et al. | 428/614 |
| 4,961,461 | 10/1990 | Klier et al. | 164/97 |
| 5,076,340 | 12/1991 | Bruski et al. | 164/97 |

FOREIGN PATENT DOCUMENTS

| | | | |
|---|---|---|---|
| 59-41428 | 3/1984 | Japan | 164/97 |
| 59-208033 | 11/1984 | Japan | 164/97 |
| 1-313179 | 12/1989 | Japan | 164/97 |
| 1093718 | 5/1984 | U.S.S.R. | 266/231 |

OTHER PUBLICATIONS

F. M. Hosking, "Compocasting of an Aluminum Alloy Composite Containing $B_4C$ Particulate", Sandia National Labs., SAND81-0976, UC-25, 1981, pp. 1-29.

Cleancast—High Performance Ceramic Filter/Flow Modifiers—Premier, brochure—6 pages, no date.

Metals Handbook, 9th Ed., vol. 15, "Casting", 1988, pp. 90-91, 95-96, 308-315, 488-493, 748-749.

*Primary Examiner*—John Zimmerman

*Attorney, Agent, or Firm*—Gregory Garmong

[57] ABSTRACT

A composite material mixture of free flowing reinforcement particles in a molten metal is solidified at a cooling rate greater than about 15° C. per second between the liquidus and solidus temperatures of the matrix alloy. This high cooling rate imparts a homogeneous structure to the solid composite material. Care is taken to avoid the introduction of gas bubbles into the molten composite material while the mixture is stirred to prevent segregation of the particles. For viscous melts, an artificial surface layer such as a fiberglass blanket may be used to prevent entrapment of bubbles during pre-casting stirring. Additionally, gas bubbles are removed from the molten mixture by filtering and skimming.

16 Claims, 3 Drawing Sheets

APPARATUS AND PROCESS FOR CASTING METAL MATRIX COMPOSITE MATERIALS

BACKGROUND OF THE INVENTION

This invention relates to cast metal-matrix composite materials, and, more particularly, to a process and apparatus for solidifying such a composite material.

Reinforced metal matrix composite materials have gained increasing acceptance as structural materials. Metal matrix composites typically are composed of reinforcing particles such as fibers, grit, powder or the like that are embedded within a metallic matrix. The reinforcement imparts strength, stiffness, wear resistance, and other desirable properties to the composite, while the matrix protects the particles and transfers load within the composite piece. The two components, matrix and reinforcement, thus cooperate to achieve results superior to those that either component could provide on its own.

Twenty years ago, reinforced composite materials were little more than laboratory curiosities because of very high production costs and their lack of acceptance by product designers. More recently, great advances in the production of nonmetallic composite materials, such as graphite-epoxy composite materials, have been made, with a significant reduction in their cost. The cost of metal-matrix composite materials has remained relatively high. In the last several years, the discovery of a processing technology that permits the reproducible production of large quantities of cast reinforced composite materials with metal matrices has significantly reduced the cost of these materials. See, for example, U.S. Pat. No. 4,759,995 and U.S. Pat. No. 4,786,467, whose disclosures are incorporated by reference.

Since the discovery of the methods of the '995 and '467 patents, many applications for cast composite materials have been developed, and their volume of use has increased significantly so that they have become a major new type of structural material. These cast metal matrix composite materials offer the property improvements of composite materials at a cost only slightly higher than that of conventional monolithic materials. The cast metal-matrix composite materials may be used at elevated temperatures or under other conditions that preclude the use of organic-matrix composite materials.

Although the processes of the '995 and '467 patents have provided a major advance in the field enabling the production of cast metal-matrix composite materials on an industrial scale, the composite structures produced by these techniques are not always optimal. For example, it has been observed that in some cases there are irregularities in the microstructures of the composite materials prepared by these approaches. These irregularities are manifested as inhomogeneous regions within the composite material wherein the reinforcement particles are not evenly distributed. Additionally, between the particles the matrix sometimes exhibits a segregated eutectic structure with a reduced melting point. These microstructural irregularities result in degraded physical properties as compared with those expected for a more homogeneous composite material.

Accordingly, there exists a need for an improved cast metal-matrix composite fabrication procedure that produces a uniform microstructure and corresponding improved properties. The present invention fulfills this need, and further provides related advantages.

SUMMARY OF THE INVENTION

The present invention provides a method and apparatus for processing molten metal-matrix composite materials into a solidified cast structure. The solid composite material produced by the approach of the invention has a more uniform, fine, porosity free microstructure than the material produced by the prior approach. Eutectic phases are spread more evenly through the metal matrix, rather than being associated exclusively with the particles. The approach of the invention may be readily utilized to economically produce commercial quantities of the cast composite material.

In accordance with one aspect of the invention, a process for preparing a solid cast composite material comprises the steps of furnishing a mixture of molten metal and solid, free flowing reinforcement particles occupying from about 5 to about 35 percent of the volume of the mixture, the mixture being agitated prior to solidification to prevent segregation of the particles, the agitation being accomplished in a manner that substantially prevents the introduction of gas into the mixture; and solidifying the mixture at a cooling rate of at least about 15° C. per second between the liquidus and the solidus temperatures of the molten metal. The furnishing step preferably utilizes the mixing processes of the '995 and '467 patents.

Regardless of how the molten mixture is solidified, prior to solidification it is gradually poured from the mixing apparatus or an intermediate holding furnace into the casting apparatus. In either case, the melt is agitated and stirred to prevent segregation of the particulate in the melt. The agitation process, unless conducted with extreme care, tends to enfold gas into the melt, and in one aspect the present invention avoids the introduction of gas in this way. In accordance with this aspect of the invention, a process for preparing a solid cast composite material comprises the steps of furnishing a mixture of molten metal and solid, free flowing reinforcement particles occupying from about 5 to about 35 percent of the volume of the mixture, the mixture being agitated prior to solidification to prevent settling of the particles, the agitation being accomplished with a mechanical covering on the surface of the mixture to prevent enfolding of gas into the mixture as the mixture is being agitated; and solidifying the mixture.

Care is also taken to remove gas bubbles from the molten metal before casting, to the extent possible. In accordance with this aspect of the invention, a process for preparing a solid cast composite material comprises the steps of furnishing a mixture of molten metal and solid, free flowing reinforcement particles occupying from about 5 to about 35 percent of the volume of the mixture, the mixture being processed prior to solidification to remove entrapped gas bubbles from the molten mixture; and solidifying the mixture.

Finally, the molten metal may be gently agitated and stirred in the casting apparatus to prevent segregation of the particulate prior to solidification.

In the '995 and '467 patents, as well as other prior approaches for producing cast composite materials of this type, the mixture of molten metal and reinforcement particulate was cast into a closed metal or ceramic chill mold at least several inches in diameter. The solidification rate of the composite material in such a steel mold has been determined to be less than about 6° C. per second, and even less in a ceramic mold.

By contrast, in the present approach the solidification rate is at least about 15° C. per second, is preferably greater than 100° C. per second, and may be over 1000° C. per second. The higher solidification rates result in a more uniform distribution of the reinforcement particles throughout the composite structure, reducing the incidence of regions denuded of reinforcement particulate and other regions in which the reinforcement is too highly concentrated.

A wide variety of casting techniques may be used. The casting technique must be one that avoids the incidence of cracking of the casting at the high solidification temperature gradients required. Normally, higher gradients are achieved only with thin sections, which have a reduced tendency toward cracking.

The incidence of large eutectic-composition areas within the matrix and adjacent the reinforcement particles is also greatly reduced, a highly significant development for the utilization of the cast composite materials. For some applications any eutectic areas must be removed by diffusional homogenization heat treatments, a time consuming operation that requires costly soaking furnaces. The long heat treatments may cause degradation of the particulate in the cast composite material. The present approach eliminates entirely the need for, or greatly shortens the time required for, such homogenization heat treatments, by avoiding the formation of large eutectic areas. Using the present process, there may be a few eutectic areas present in the microstructure, but they are much smaller than those produced by prior procedures, and are more evenly distributed through the structure. Being smaller in size and more evenly distributed, they either do not adversely affect properties and may be ignored, or may be eliminated by mechanical working or much shorter homogenization heat treatments than required for the larger eutectic areas of prior processes.

The present invention also provides a form of apparatus for producing the cast composite material, although other suitable apparatus can also be used. In accordance with this aspect of the invention, apparatus for preparing a cast composite material comprises supply means for supplying a mixture of molten metal and solid, free flowing reinforcement particles; mold means for defining the shape of the solidified mixture, the mold means including a hollow sleeve mold having side walls whose interior lateral surfaces define a channel in the shape of the solidified mixture, and having opposing ends of the channel open; reservoir means for receiving the flow of the mixture from the supply means and acting as a reservoir for the mold means; means for stirring the mixture to aid in retaining a uniform distribution of particles in the mixture; and withdrawal means for removing the solidified mixture from the other end of the mold means, the mold means and the withdrawal means cooperating to impose a cooling rate throughout the volume of the mixture of at least about 15° C. per second. For aluminum-based alloys, this cooling rate is maintained in the temperature range of about 600°-650° C.

More specifically, apparatus for preparing a cast composite material comprises a mixer in which is prepared a mixture of molten metal and solid, free flowing reinforcement particles, the mixture having substantially no dissolved or entrapped gas therein; a water cooled hollow sleeve mold having side walls whose interior lateral surfaces define a channel in the shape of the solidified mixture, and having opposing ends of the channel open, the sleeve mold being vertically disposed so that one of the ends is a top end and the other a bottom end; reservoir means for maintaining a flow of the mixture from the mixer to one end of the sleeve mold, the reservoir means including an insulated mixture reservoir disposed above the sleeve mold, the reservoir being adapted for receiving mixture from a launder and holding the mixture with the metal in the molten state prior to the entry of the mixture into the top end of the sleeve mold, and mixing means for stirring the mixture contained in the reservoir to aid in retaining a uniform distribution of reinforcement in the mixture; and a water cooled withdrawal support that supports and gradually withdraws the solidified mixture from the bottom end of the sleeve mold, the sleeve mold and the withdrawal support cooperating to impose a cooling rate on the mixture of at least about 15° C. per second throughout the volume of the mixture.

The invention also provides apparatus for maintaining the molten composite material in a mixed state while it is awaiting pouring into the casting apparatus. In this aspect of the invention, apparatus for preparing a cast composite material comprises a mixer which stirs a mixture of molten metal and solid, free flowing reinforcement particles to prevent the particles from segregating within the mixture; and a mechanical covering on the surface of the mixture to prevent enfolding of gas into the mixture as the mixture is being stirred.

This solidification apparatus provides a semicontinuous or continuous solidification procedure for the composite material. A relatively steady thermal gradient and solidification rate are established in the apparatus, so that the composite is uniform from end to end. By contrast, a composite material cast in a chill mold exhibits macroscopic structural variations.

The apparatus also imposes the relatively high cooling rate of more than 15° C. per second onto the solidifying composite material, resulting in the improved microstructure discussed previously.

The present invention thus is an important advance in the art of cast composite materials. More uniform microstructures are produced using the invention, that yield improved properties. Other features and advantages of the invention will be apparent from the following more detailed description of the preferred embodiment, taken in conjunction with the accompanying drawings, which illustrate, by way of example, the principles of the invention.

DETAILED DESCRIPTION OF THE PREFERRED EMBODIMENT

The invention relates to a cast composite material of reinforcement particles in a metal alloy matrix. The composite material is first prepared with particles mixed into a molten metallic alloy, and then the alloy is solidified with the particles retained in a dispersed state. The mixing procedure is preferably that set forth in U.S. Pat. No. 4,759,995 or U.S. Pat. No. 4,786,467, whose disclosures are incorporated by reference, although the utilization of the present invention is not limited to those specific techniques. The reinforcement particles are necessarily present as a solid, distinguishable form mixed with the molten alloy. (Thus, the particles are not of the type created when a homogeneous eutectic composition of molten alloy solidifies, to form a eutectic reinforced composite material, and are also not of the type produced in the solid state by cooling from a single-phase to a two-phase region.) The reinforcement particles are preferably refractory, glassy, or ceramic materials, such as silicon carbide or aluminum oxide. The particles are relatively small in size, typically 1–50 micrometers in diameter, although the invention is not so limited.

The particles must, however, be "free flowing" in the molten matrix. As used herein, this term means that the particles are discontinuous, are not anchored or bound to a substrate or a support, are not rigidly fixed in space, are not collectively of such a high fraction of the total volume of the composite material that they cannot move about freely relative to each other during mixing prior to solidification of the metallic alloy, and are not otherwise constrained in their movement through the molten alloy other than by the viscosity of the molten alloy. The term "free flowing" should not be understood to suggest any particular fluidity, as a relatively viscous mixture may be free flowing in the sense described above.

After mixing of the molten alloy and the reinforcement particles, the mixture is converted to a solid by solidifying the molten matrix. The particles, which are solid in the molten alloy, remain solid during the solidification, and the metal alloy solidifies to form a solid metallic matrix of the composite material.

Figure 1:
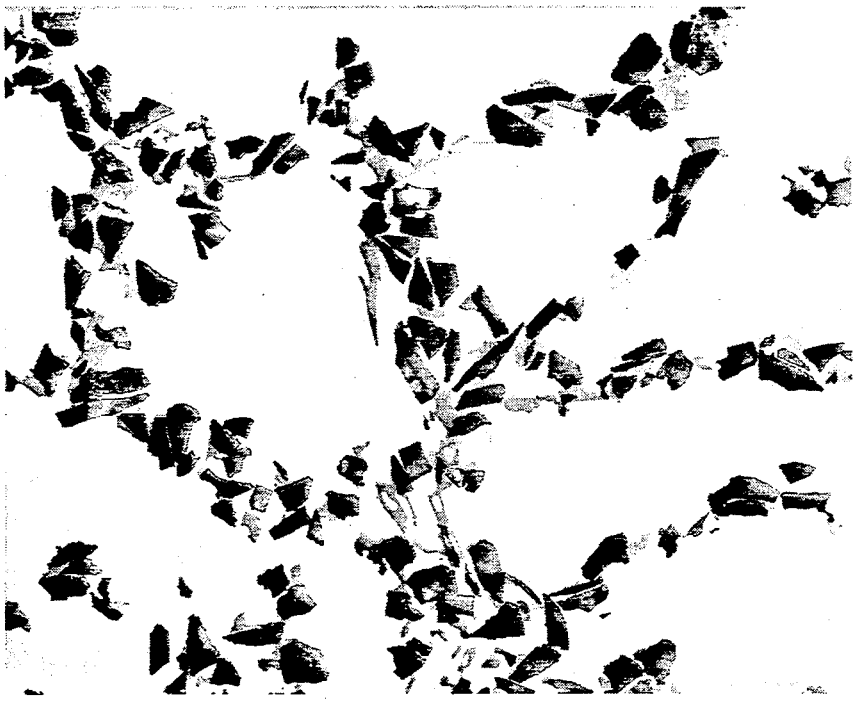
FIG. 1 PRIOR ART
FIG. 1 is a micrograph at moderate magnification illustrating the microstructure produced by the prior approach.
Figure 2:
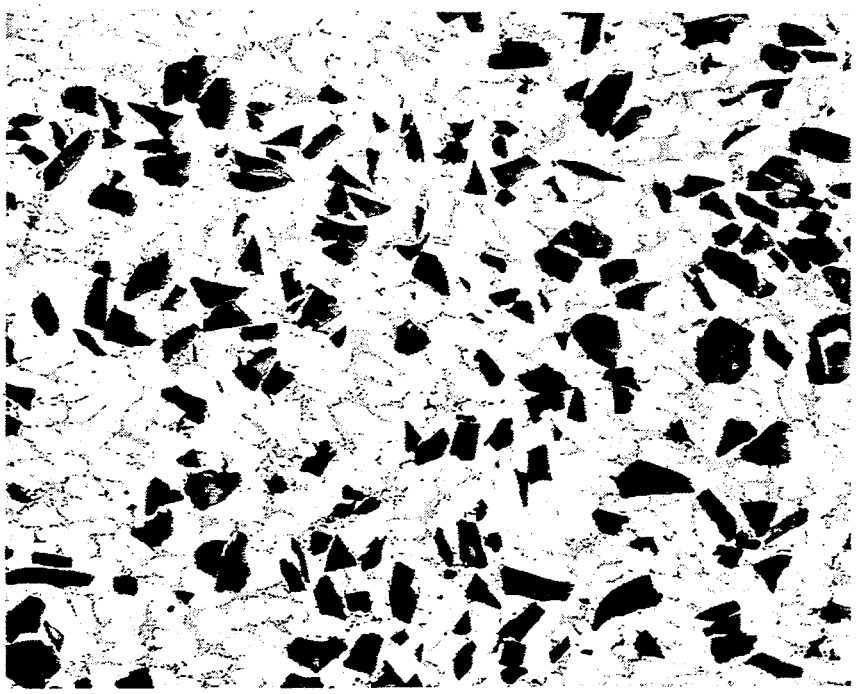
FIG. 2 is a micrograph at moderate magnification illustrating the microstructure produced using the present invention.
Figure 3:
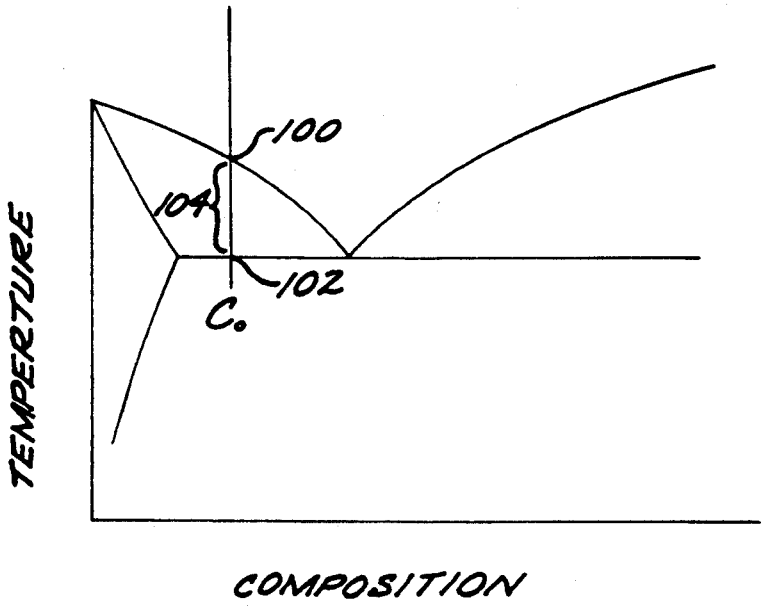
FIG. 3 is a schematic illustration of a portion of a phase diagram illustrating the solidification range of a typical matrix alloy.

FIGS. 1–2 illustrate the effect of solidification rate on the microstructure of the composite material. The solidification rate of interest is the local solidification rate experienced by the matrix alloy of composition $C_o$ between the liquidus line or temperature 100 and the solidus line or temperature 102, as illustrated in FIG. 3, over the solidification range 104. The cooling rates just above the liquidus temperature and just below the solidus temperature are normally close to those in the solidification range 104, but more generally the solidification rate at significantly higher or lower temperatures is not pertinent. For the preferred aluminum-based alloys used as the matrix of the cast composite materials, the solidification range 104 is typically below about 650° C. and above about 600° C.

FIG. 1 illustrates the prior art microstructure formed when a composite material consisting of about 15 volume percent of silicon carbide particles and about 85 volume percent of an aluminum alloy containing about 7 weight percent silicon is cast into a steel mold and solidified. The cooling rate from the liquidus to the solidus temperatures is determined as about 4° C. per second. The microstructure of the composite material has a cellular matrix with second phases segregated to the intercellular boundaries. FIG. 1 shows dark-appearing silicon carbide particles in an aluminum alloy matrix. Between some of the particles are coarse patches of grey-appearing eutectic region. Both the particles and the eutectic regions are segregated to the cell boundaries. Consequently, there are denuded regions within the structure, having no silicon carbide particles.

The presence of the denuded regions and the coarse eutectic regions are of concern, as both tend to impair the physical and mechanical properties of the composite material. In principle, the coarse eutectic regions could be removed by very long homogenization heat treatments at temperatures below, but near to, the solidus temperature, or could be broken up by extensive post-solidification mechanical working. Such heat treatments are expensive and time consuming, and may have adverse effects on the particles. It is doubtful whether the denuded regions could be removed by any heat treatment short of remelting the material.

By way of contrast, FIG. 2 illustrates the microstructure produced by solidification of the same composite material in a manner such that the solidification rate in the solidification range is greater than about 15° C. per second. In particular, the microstructure of FIG. 2 was obtained with a solidification rate of about 1600° C. per second in a twin roll caster. The structure has very few denuded regions, and the extent of the denudation is much less than for the structure shown in FIG. 1. The eutectic regions are much smaller in extent and separated from the particles. This structure does not suffer degradation from the segregation/denudation effect, nor any significant reduction in properties from the presence of eutectic regions associated with the particles. The thin eutectic regions shown in FIG. 2 can be broken up and homogenized during secondary fabrication treatments such as extrusion or rolling, but in any event have little adverse effect on the properties of the composite material.

Thus, the increased cooling rate through the solidification range improves both the distribution of the particles within the composite material, and the distribution of the eutectic phase within the metallic matrix of the composite material. Although not wishing to be bound by this possible explanation, it is believed that the basis for both improvements in structure arises from the nature of the solidification. The particles are rejected from the solidifying interface toward the intercellular boundaries of the aluminum matrix alloy. When the cell size of the matrix alloy is large, extensive segregation and denuded regions result. When the cell size of the matrix alloy is small, the apparent extent of segregation is greatly reduced.

It has been determined that when the cell size of the aluminum matrix alloy is less than about the interparticle spacing, or about 25 micrometers for typical examples of commercial interest, an acceptably homogeneous structure results. For most aluminum alloys, a solidification rate between the liquidus and solidus temperatures of about 15° C. per second produces an aluminum alloy cell size of about 25 micrometers. Thus, the selection of the solidification rate of 15° C. per second is critically related to the resulting microstructure and, in turn, the relationship between interparticle spacing and matrix alloy cell size. A higher solidification rate produces a smaller cell size, which is even more preferred.

For a preferred particulate material, the average particulate size is about 10 micrometers and the average interparticle spacing about 22–28 micrometers depending upon the volume fraction of the particulate in the range of about 10–20 volume percent, so that the maximum cell size to achieve an acceptably homogeneous structure is about 1.0 times the average particle spacing. In FIG. 1, for example, the cell size is on the order of 35 micrometers, about 1.5 times the average interparticle spacing. In FIG. 2, the cell size is on the order of about 5 micrometers, which is far less than the average interparticle spacing. The particle sizes do not vary with solidification gradient, but the cell size decreases with increasing solidification rate. Thus, at some point of increasing rate, about 15° C. per second, the above criteria are met and the acceptably homogeneous structure results.

Thus, a cast composite material in accordance with the invention comprises a distribution of from about 5 to about 35 volume percent of reinforcing particles distributed in an aluminum-alloy matrix, the matrix having an as-cast microstructure with a cell size less than the average interparticle spacing of the reinforcing particles. In a preferred embodiment, cell size of the matrix is less than about half the mean interparticle spacing of the reinforcing particles.

In another preferred embodiment, a cast composite material comprises a distribution of from about 5 to about 35 volume percent of reinforcing particles distributed in an aluminum-alloy matrix, the matrix having an as-cast microstructure with a cell size less than the average particle size of the reinforcing particles.

Thus, in accordance with this aspect of the invention, a process for preparing a solid cast composite material comprises the step of furnishing a mixture of molten metal and solid, free flowing reinforcement particles occupying from about 5 to about 35 percent of the volume of the mixture. The mixture is agitated prior to solidification to prevent segregation of the particles. The agitation is accomplished in a manner that substantially prevents the introduction of gas into the mixture. The mixture is solidified at a cooling rate between the liquidus and the solidus temperatures of the molten metal such that the average cell size of the matrix is no greater than about the interparticle spacing of the particles. The average cell size is no greater than about 25 micrometers in one embodiment. Preferably, the cooling rate is such that the average cell size of the matrix is no greater than about half the interparticle spacing of the particles, about 12 micrometers in one embodiment.

This determination of the solidification rate at which an acceptable structure results is necessarily somewhat qualitative, but serves as a useful guideline in designing solidification procedures. The maximum cell size of about 25 microns results in a small but acceptable segregation at the cell boundaries. On the other hand, even higher solidification rates, as exemplified by that of FIG. 2, achieve an even more homogeneous structure.

Thus, more preferably, the cell size is less than about 10–12 micrometers, corresponding to a cell size of about one-half the interparticle spacing. This cell size is produced at a solidification rate of about 100° C. per second or more.

The above determination of solidification rates required to achieve particular acceptable microstructures is based upon estimates using the criterion of a cell size that is not greater than the interparticle spacing, and preferred particle size of about 10 micrometers and preferred volume fraction of particles of about 10–20 volume percent. If the particle size were significantly higher or lower, or the volume fraction of particles were significantly higher or lower, or the particle shape were significantly different, then similar estimates could be used to determine required cell sizes and solidification rates.

The term "about" has been used in describing the interrelationships of solidification rate, cell size, and average particle size. In this instance, that term has physical significance, because the interrelationships are not exact or general. There may be variation depending, for example, upon the composition of the matrix alloy. However, solidification studies have indicated that for many alloys the above generalizations are useful engineering approximations.

The approach of the present invention is operable over a range of from about 5 to about 35 volume percent of the reinforcement particles. Below about 5 percent, effects of the presence of the reinforcement are so small that the effects of denuded regions are negligible. Above about 35 percent, the reinforcement does not flow freely in the molten matrix in the sense used herein, and particulate constraint effects dominate the solidification processing.

The preferred apparatus for accomplishing the mixing of the particulate into the molten matrix alloy, prior to casting, is disclosed in U.S. Pat. Nos. 4,759,995 and 4,786,467, whose disclosures are incorporated by reference.

Figure 4:
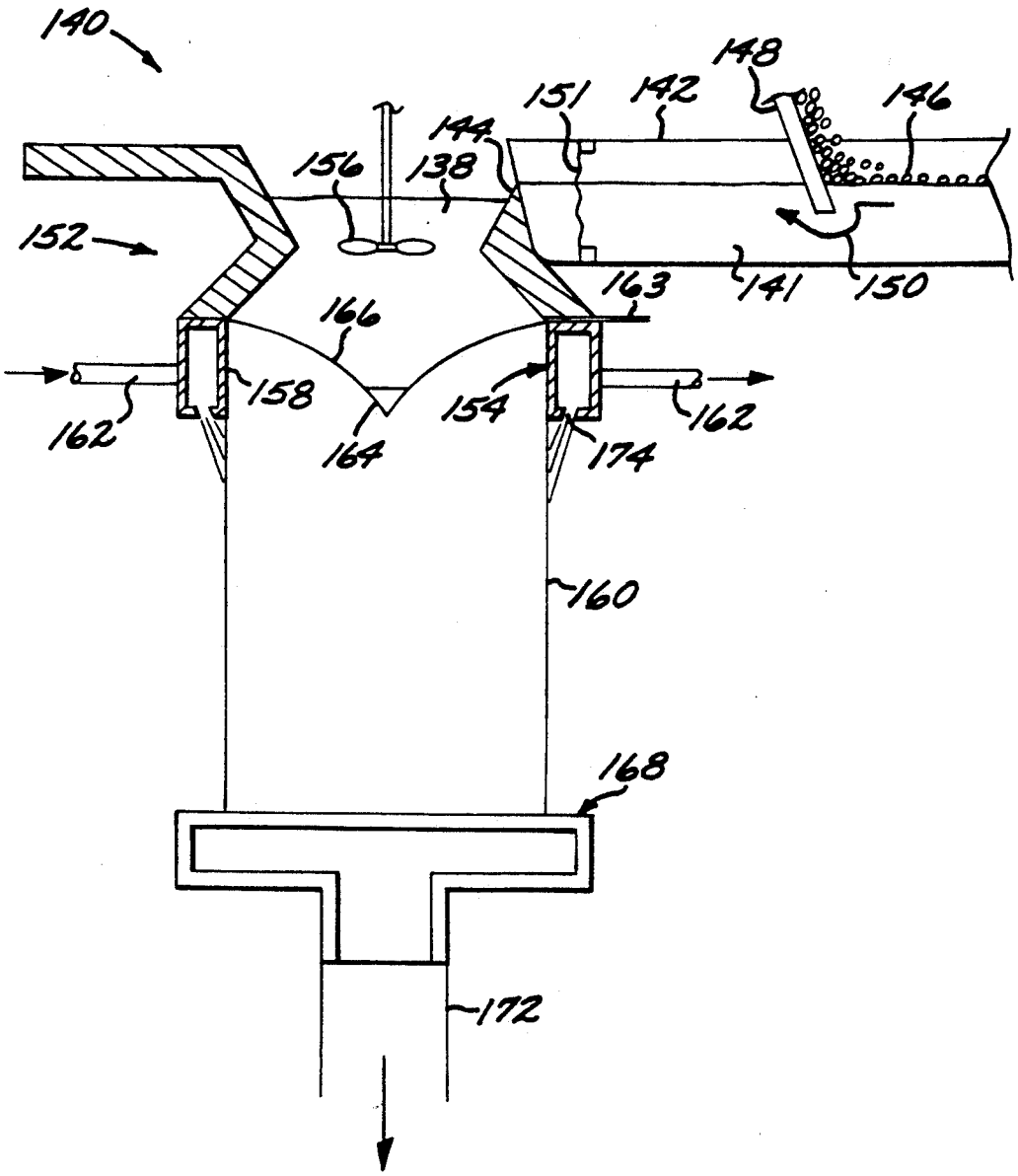
FIG. 4 is a side sectional view of one preferred embodiment of a casting apparatus.

The mixture of molten metal and solid reinforcement particulate prepared by the apparatus of the '995 or '467 patents is conveyed to a casting apparatus 140, illustrated in FIG. 4, by a supply means. A mixture 141 of particles and molten matrix alloy is conveyed through an insulated through or launder 142. The level of the molten mixture 138 in the launder 142 is established by the height of the spillway 144.

The mixing apparatus is designed to avoid the introduction of gas into, and retention of gas within, the composite material as it is mixed. However, gas can enter the molten mixture 138 as it is poured from the mixer into the launder 142, or as it flows along the launder 142 if there is any substantial turbulence. Accordingly, there may be gas bubbles 146, oxide skins, or froth on the surface of the mixture 141 in the launder. The gas bubbles, oxide skins, and froth are removed form the surface of the mixture 141, preferably with a skimmer 148.

The skimmer 148 is a piece of ceramic insoluble in the molten aluminum-based matrix alloy, such as aluminum oxide. It extends downwardly into the mixture in the launder 142 from above the surface of the flowing mixture 141, forcing the mixture to flow below the skimmer 148, as indicated schematically by the arrow 150. Bubbles 146 are skimmed from the surface of the mixture 141, and may later be removed. The bubbles are prevented from reaching the casting head by the skimmer 148. Alternatively, the skimmer 148 can be a plate with an aperture therethrough below the surface of the molten mixture, so that the molten mixture is forced to flow through the aperture.

Gas bubbles are also removed from the flow of molten metal by one or more strainers or filters 151. The filter 151, which may include a single filter element or two or more elements in series, is immersed into the flow of composite mixture 141 in the launder 142, prior to the flow entering the casting apparatus. Each filter 151 is preferably made of a porous material having pores of selected size, which is stable in the molten composite mixture. That is, the filter may not dissolve or fail as the mixture 141 flows through it. One filter 151 is a woven fiberglass sock of either #32 weave having 50 holes per square inch or #30 weave have 25 holes per square inch. Another filter is a porous foam filter, normally placed downstream of the fiberglass filter, having between 5 and 10 pores per cubic inch. The foam filter removes additional oxide skins and bubbles.

The filtered mixture 141 flows from the launder 142 into a hot top 152, which includes an insulated, and possibly heated, reservoir sitting above a sleeve mold 154. The hot top 152 maintains a hydrostatic pressure head above the mixture that solidifies in the mold 154, maintaining an even supply of mixture into the mold 154 and reducing the likelihood of incorporation of gas into the solid composite material. The mixture 141 in the feed head is retained with the metal in the molten state. A stirring impeller 156 is immersed into the molten mixture 138. The impeller 156 is rotated to maintain a low degree of agitation in the mixture 141. It is not the objective of the impeller 156 to wet the particles to the metal, as that was accomplished in the mixer. Instead, the impeller 156 prevents the reinforcement particulate from segregating by settling (or, in a few cases, rising) and thus forming segregated regions in the molten mixture 141 prior to its solidification.

The sleeve mold 154 includes an inner side wall 158 whose shape defines the shape of a solidfied ingot 160 of composite material that emerges from the mold 154. Typically, the side wall 158 defines a circle, so that the ingot 160 is a circular cylinder, or a rectangle, so that the ingot 160 is a right rectangular prism, but any required shape can be utilized. The sleeve mold 154 is hollow and is water cooled by cooling lines 162. Lubricant such as oil is introduced around the inner circumference of the wall 158 through a lubricant line 163. The side wall 158 encircles the ingot 160, leaving both ends of the mold 154 open.

The mixture 141, with the metal in the molten state, flows into the top end of the mold 154. Heat is removed from the portion adjacent the side wall 158 due to the water cooling, causing the metal of the mixture 141 to solidify first immediately adjacent to the side wall 158. The central portion 164 of the mixture 141 solidifies last (in the sense that the metal of the mixture solidifies last), producing a V-shaped solid/liquid interface 166. Below the interface 166, the mixture is entirely solid, forming the ingot 160.

The ingot 160 is started by placing a mold plug 168 against the bottom of the bottom end of the mold 154, and pouring in the liquid mixture 141. The mold plug 168 is mounted on a pedestal 172 that is lowered at a controllable rate into a pit (not shown).

Water jets 174 spray continuous streams of water against the sides of the ingot 160, after it has emerged from the bottom end of the sleeve mold 154, to increase the rate of extraction of heat from the ingot.

The combination of the thermal gradient, in degrees C per centimeter, as established by the water cooling of the mold 154 and the ingot 160, and the downward rate of movement of the pedestal 174, in centimeters per second, determines the rate of solidification of the mixture 138, in degrees C per second. As a practical matter in casting experience, the cross sectional size of the casting determines the maximum rate of heat withdrawal, and thence limits the solidification rate that can be achieved for that casting. A second, metallurgical limitation on the solidification rate is the susceptibility of the solidifying material to cracking.

The casting apparatus 140 operates in a semicontinuous manner. That is, casting is continuous, but only for the downward length of travel of the pedestal 172. The apparatus 140 achieves cooling rates in excess of 15° C. per second, and in excess of 100° C. per second for billets of relatively small size.

Continuous casters are known in the art. Fully continuous twin belt continuous casting apparatus is disclosed in U.S. Pat. Nos. 4,061,177 and 4,061,178, and a continuous twin roll casting apparatus is disclosed in U.S. Pat. No. 4,723,590, all of whose disclosures are incorporated by reference. Such fully continuous casting apparatus can achieve cooling rates well in excess of 100° C. per second, and often in excess of 1000° C. per second.

Returning to the discussion of the semi-continuous casting apparatus of FIG. 4, the casting of a large volume of the composite material by the casting apparatus may require a long period of time, up to an hour or more. The molten mixture is typically held during that period in the mixing furnace, or in an intermediate holding facility, from which it is poured into the launder than thence flowed to the casting apparatus. During this holding period, it is continuously agitated or stirred to prevent segregation of the particulate due to density differences with the molten metal.

Observations of completed castings have revealed that the initial portion of the casting is relatively free of gas pores, indicating that the combination of careful mixing, care in pouring, the skimmer 148, and the filters 151 are sufficient to produce a satisfactory product, at least initially.

However, the portions of the casting that are cast later tend to have a higher degree of porosity, indicating that the longer mixing time tends to introduce gas into the molten composite material. This condition persists even though great care is taken to maintain the operating conditions precisely uniform during the entire casting process.

The increasing porosity of the casting with time and volume of metal cast has been traced to the prolonged agitation and stirring of the composite material in the mixer or holding furnace. Even when great care is taken to maintain a quiet surface on the melt, the agitation and stirring inevitably introduces gas into the melt by a lapping and enfolding action. The amount of gas introduced increases with the intensity of the agitation and, even with a relatively low intensity of agitation, with increasing time. The gas that is thus introduced into the molten composite material is entrained, and cannot be readily removed. The increasing gas content of the molten material in the mixer or holding furnace has been confirmed with viscosity measurements, which show increasing viscosity of the melt with time, and by observations of the filters 151, which become clogged more rapidly later in the casting operation than earlier in the casting operation.

The problem of ever-increasing gas incorporation into the molten composite material has been solved by providing a mechanical surface barrier to the incorporation of gas into the molten composite material as it is agitated. The mechanical surface barrier greatly reduces the lapping or enfolding action at the surface of the molten composite material, thereby greatly reducing the cumulative introduction of gas into the molten composite material during prolonged agitation and stirring.

Figure 5:
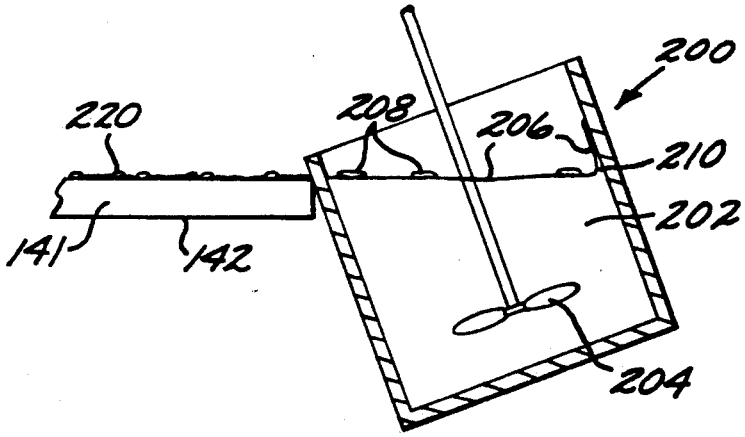
FIG. 5 is a side sectional view of a holding furnace with a mechanical covering on the surface of the melt.

FIG. 5 illustrates a holding furnace 200 containing a molten composite material melt 202. The melt 202 is continuously stirred and agitated by a stirrer 204. (The agitation and stirring action required to prevent segregation of the particles is much less than required to attain wetting of the particles.) Alternative stirring and agitation devices may also be used. It is this stirring and agitating that entraps gas in the molten melt 202, with the amount of entrapped gas increasing with increasing time of stirring.

A preferred mechanical surface barrier is a piece of fiberglass cloth 206, which is stable to dissolution or other deterioration in the molten composite material, which is laid onto the surface of the molten melt 202. Floats 208 made of a material that floats on the molten aluminum are sewed or otherwise attached to the fiberglass cloth 206, to prevent it from sinking into the melt 202. The preferred float material is fiberboard of the type commonly used as insulation. The fiberglass cloth 206 is laid onto the surface of the melt 202 prior to the commencement of pouring of the melt into the launder 142. The molten metal of the melt 202 works through the openings of the fiberglass cloth 206, so that the cloth 206 is floating at the surface but in a semi-submerged state. The floats 208 prevent the cloth from sinking any further into the melt.

It is desirable that the mechanical surface barrier cover the entire surface of the melt 202, as any uncovered areas will tend to absorb gas. The fiberglass cloth 206 is therefore preferably cut oversize, so that initially the cloth extends up the interior walls of the holding furnace 200, as indicated at numeral 210. As the holding furnace 200 is tilted further, the surface of the melt 202 increases, and the extra material extending up the walls is gradually pulled down onto the exposed surface of the melt. In this way, the size of the mechanical surface barrier is automatically adjusted. For bottom pouring or other technique where the mixing or holding furance is not tilted, the fiberglass cloth can be cut to the size of the top of the melt, or left oversize as desired. The mechanical surface barrier desirably covers the entire surface area of the melt during the entire holding and pouring operation.

Other approaches to providing a mechanical surface barrier are also operable. A layer of ceramic balls, glass balls, or even charcoal is operable to still the surface of the melt. A layer of a low melting point salt can also be placed onto the surface of the melt to quiet it. The use of the fiberglass cloth is preferred, however, because it is easy to handle and to remove when the pouring operation is complete.

For more fluid (less viscous) alloys, the mechanical surface control may not be required, as they have a reduced tendency to incorporate gas into the molten material during mixing.

The operability of this approach has been demonstrated by removing the mechanical surface barrier at the later stages of experimental casting runs. Where the surface barrier is present, the porosity of the casting is low initially and remains low through the entire duration of the casting operation, even up to several hours of casting. Where the surface barrier is removed at an intermediate point of the casting operation, subsequent inspection of the resulting ingot shows that removal of the barrier leads to the introduction of an increasing amount of porosity.

The surface barrier may also be used on the launder 142, as illustrated by a barrier cloth 220 floating on the mixture 141 in the launder 142. A similar surface barrier approach is applicable wherever gas may become entrapped in the mixture 141.

The following examples illustrate aspects of the invention, and are not limiting of the invention in any respect.

EXAMPLE 1

A cast composite material of 15 volume percent silicon carbide particles in an alloy of aluminum-7 weight percent silicon was solidified at a rate of about 4° C. per second in a steel mold. The microstructure of the resulting material is illustrated in FIG. 1.

EXAMPLE 2

Example 1 was repeated, except that solidification was accomplished in a twin roll caster as disclosed in U.S. Pat. No. 4,723,590, at a solidification rate of about 1600° C. per second. The structure of that alloy is shown in FIG. 2.

EXAMPLE 3

Heats of 2014 aluminum having 10 volume percent aluminum oxide reinforcement particles were prepared by (1) a low pressure casting technique in which the composite material was cast into a steel mold and solidified at a rate of about 4° C. per second, and (2) a semi-continuous casting technique in which the composite material was cast using an apparatus like that illustrated in FIG. 4, with a solidification rate of greater than about 15° C. per second.

The material produced by low pressure casting had a yield strength of 62,800 pounds per square inch (psi), an ultimate tensile strength of 66,200 psi, and an elongation at failure of 2.75 percent. Its structure is similar to that illustrated in FIG. 1. The material produced by semi-continuous casting had superior properties, with a yield strength of 68,400 psi, an ultimate tensile strength of 73,000 psi, and an elongation of 4.0 percent.

EXAMPLE 4

A number of cast composite materials were prepared using the apparatus illustrated in FIG. 4. The alloys are listed in Table I, together with the ranges of volume fractions of the $Al_2O_3$ particulate phase that were prepared in each case.

TABLE I

| Alloy No. | Matrix Alloy | Vol. Fraction Range |
|---|---|---|
| 1 | 1060 | 5–20 |
| 2 | 1060 | 5–20 |
| 3 | 2014 | 10–20 |
| 4 | 2014 | 10–20 |
| 5 | 6061 | 10–20 |
| 6 | 6061 | 10–20 |
| 7 | 2519 | 10–20 |

Casting conditions for the various alloy systems are indicated in Table II.

TABLE II

| Alloy No. | Mold Size (in) | No. of Molds | Metal Temp (F.) | Casting Speed (in/min) |
|---|---|---|---|---|
| 1 | 7 | 5 | 1325 | 5.0 |
| 2 | 10.625 | 2 | 1320 | 3.65 |
| 3 | 7 | 5 | 1285 | 5.0 |
| 4 | 9 | 3 | 1285 | 4.0 |
| 5 | 7 | 5 | 1300 | 4.75 |
| 6 | 10.625 | 2 | 1290 | 3.0 |
| 7 | 7 | 5 | 1290 | 4.5 |

The present invention provides an important advance in the art of the commercial manufacture of cast, metal matrix composite materials. High quality, microstructurally homogeneous composite material can be prepared on a commercial scale with the invention. Although particular embodiments of the invention have been described in detail for purposes of illustration, various modifications may be made without departing from the spirit and scope of the invention. Accordingly, the invention is not to be limited except as by the appended claims.

What is claimed is:

1. A process for preparing a solid cast composite material, comprising the steps of:

furnishing a mixture of molten metal and solid, free flowing reinforcement particles occupying from about 5 to about 35 percent of the volume of the mixture, the step of furnishing including a step of mixing the molten metal and the particles in a mixing apparatus to wet the molten metal to the particles;

conveying the mixture of molten metal and particles from the mixing apparatus to a solidification apparatus;

agitating the mixture after the mixture has left the mixing apparatus and prior to solidification to prevent segregation of the particles, the agitation being accomplished in a manner that substantially prevents the introduction of gas into the mixture; and solidifying the mixture at a cooling rate of at least about 15° C. per second between the liquidus and the solidus temperatures of the molten metal.

2. The process of claim 1, wherein the step of furnishing includes the step of placing a mechanical covering on the surface of the mixture to prevent enfolding of gas into the mixture as the mixture is being agitated.

3. The process of claim 2, wherein the mechanical covering is a blanket of a material that is stable in contact with the molten mixture.

4. The process of claim 1, wherein the step of furnishing includes the step of removing entrapped gas bubbles from the molten mixture.

5. The process of claim 4, wherein the step of removing is accomplished by passing the molten metal through a filter that permits the metal and particles to pass therethrough, but prevents the passage of gas bubbles.

6. The process of claim 4, wherein the step of removing is accomplished by passing the metal through a submerged opening, thereby preventing the passage of surface foam and bubbles.

7. The process of claim 1, wherein the molten metal is an alloy of aluminum.

8. The process of claim 1, wherein the reinforcement particles are selected from the group consisting of metallic oxides, carbides, and nitrides.

9. The process of claim 1, wherein the reinforcement particles are aluminum oxide.

10. The process of claim 1, wherein the reinforcement particles are silicon carbide.

11. The process of claim 1, wherein the cooling rate is from about 15° to about 100° C. per second.

12. The process of claim 1, wherein the cooling rate is greater than about 100° C. per second.

13. The process of claim 1, wherein the reinforcement particles are a glass.

14. A process for preparing a solid cast composite material, comprising the steps of:

furnishing a mixture of molten metal and solid, free flowing reinforcement particles occupying from about 5 to about 35 percent of the volume of the mixture, the mixture being agitated prior to solidification to prevent settling of the particles, the agitation being accomplished with a mechanical covering on the surface of the mixture to prevent enfolding of gas into the mixture as the mixture is being agitated; and solidifying the mixture.

15. A process for preparing a solid cast composite material, comprising the steps of:

furnishing a mixture of molten metal and solid, free flowing reinforcement particles occupying from about 5 to about 35 percent of the volume of the mixture, the mixture being agitated prior to solidification with a mechanical covering on the surface of the mixture to prevent enfolding of gas into the mixture as the mixture is being agitated, the mixture being processed prior to solidification to remove entrapped gas bubbles from the molten mixture; and solidifying the mixture at a cooling rate of at least about 15° C. per second between the liquidus and the solidus temperatures of the molten metal.

16. Apparatus for preparing a cast composite material, comprising:

a mixer in which is prepared a mixture of molten metal and solid, free flowing reinforcement particles, the mixture having substantially no dissolved or entrapped gas therein;

a water cooled hollow sleeve mold having side walls whose interior lateral surfaces define a channel in the shape of the solidified mixture, and having opposing ends of the channel open, the sleeve mold being vertically disposed so that one of the ends is a top end and the other a bottom end;

reservoir means for maintaining a flow of the mixture from the mixer to one end of the sleeve mold, the reservoir means including an insulated mixture reservoir disposed above one end of the sleeve mold, the reservoir being adapted for receiving mixture from the mixer and holding the mixture with the metal in the molten state prior to the entry of the mixture into the top end of the sleeve mold, and mixing means for stirring the mixture contained in the reservoir to aid in retaining a uniform distribution of reinforcement in the mixture; and a water cooled withdrawal support that supports and gradually withdraws the solidified mixture from the bottom end of the sleeve mold, the sleeve mold and the withdrawal support cooperating to impose a cooling rate on the mixture of at least about 15° C. per second throughout its volume.

* * * * *